US006688139B2

(12) United States Patent
Tschetter

(10) Patent No.: US 6,688,139 B2
(45) Date of Patent: Feb. 10, 2004

(54) METHOD AND APPARATUS FOR INTERCONNECTING JEWELRY ELEMENTS

(76) Inventor: Patricia Tschetter, 5829 Joyce Way, Dallas, TX (US) 75225-1624

( * ) Notice: Subject to any disclaimer, the term of this patent is extended or adjusted under 35 U.S.C. 154(b) by 0 days.

(21) Appl. No.: 09/880,350

(22) Filed: Jun. 13, 2001

(65) Prior Publication Data

US 2002/0189286 A1 Dec. 19, 2002

(51) Int. Cl.[7] ..... A44C 17/02
(52) U.S. Cl. ..... 63/31; 63/3; 63/15; 63/26
(58) Field of Search ..... 63/3, 26, 31, 15

(56) References Cited

U.S. PATENT DOCUMENTS

| | | | | | |
|---|---|---|---|---|---|
| 1,855,331 | A | | 4/1932 | Bernier | |
| 2,205,918 | A | * | 6/1940 | Bangs | 40/620 |
| 2,653,402 | A | * | 9/1953 | Bonagura | 40/662 |
| 2,812,600 | A | * | 11/1957 | Hopp | 40/650 |
| 3,242,690 | A | * | 3/1966 | Kettell | 63/29.1 |
| 3,273,766 | A | * | 9/1966 | Cosentino | 224/197 |
| 3,483,716 | A | * | 12/1969 | Stenzler | 63/15 |
| 4,294,084 | A | * | 10/1981 | Lampert | 63/15 |
| 4,796,442 | A | * | 1/1989 | Sarcona | 63/26 |
| 4,821,533 | A | | 4/1989 | Bonnefoy | 63/3 |
| 5,003,678 | A | | 4/1991 | Oganesyan | 29/10 |
| 5,606,873 | A | | 3/1997 | Zeller et al. | 63/15 |
| 5,758,945 | A | | 6/1998 | Lima | 362/84 |
| 5,896,757 | A | * | 4/1999 | Kharloubian | 63/31 |
| 6,065,971 | A | | 5/2000 | Lennon | 434/246 |
| 6,311,520 | B1 | * | 11/2001 | Alfano | 63/12 |

* cited by examiner

*Primary Examiner*—Andrea Chop
(74) *Attorney, Agent, or Firm*—Gardere Wynne Sewell LLP; Kenneth T. Emanuelson

(57) ABSTRACT

An apparatus and method for interconnecting jewelry elements. In various embodiments, the apparatus comprises a first jewelry element having a track disposed therein and a second jewelry element having a feature shaped and sized to traverse the track. In one embodiment, the invention comprises a bracelet having two or more tracks disposed on the surface thereof and a mounted jewel having a base shaped to travel within one or more of the tracks.

18 Claims, 4 Drawing Sheets

METHOD AND APPARATUS FOR INTERCONNECTING JEWELRY ELEMENTS

TECHNICAL FIELD OF THE INVENTION

The present invention relates generally to the field of jewelry in general, and in particular to methods and structures for connecting pieces of jewelry to one another.

BACKGROUND OF THE INVENTION

Ornamental rings worn on fingers, such as wedding bands, engagement rings and the like are generally made of precious metals such as gold, silver or platinum, and are configured to snugly fit onto fingers, with sized measurement. The interiors of these rings are generally shaped as cylindrical sections, in order to conform to the shape of the fingers on which they are placed. The portion of the exterior of the cylindrical section of a ring which is positioned adjacent the palm of a wearer is generally not ornamented, in order to avoid irritation of the hand. The remaining portions of the ring (except for simple bands) are generally adorned with carvings or etchings, and may incorporate other elements, including set gems with settings.

The most expensive ring jewelry is provided with setting elements and precious stones set therein. Common setting elements included raised prongs, which engage portions of the precious stones (e.g., the girdle of a commonly cut diamond), and channels formed in the band itself having internal notches, which engage the girdle or edges of the stone or stones. Clear glue or adhesive is sometimes used with inexpensive rings of a costume jewelry type, to hold ersatz stones in place. Rings with channels and internal notches for accommodation of precious gems are generally made with the channels having open bases, in the ring metal beneath the set stones, to permit full light transmission through the stones to enhance brilliance thereof.

A number of patents have been issued for various jewelry settings. U.S. Pat. No. 5,606,873, for example, discloses a finger ring structure, particularly for rings having precious stones set therein. The ring comprises a standard section of a cylinder, with an inner surface and an outer surface, and is modified such that the circumferential edges of the inner surface are inwardly rounded and wherein the rounded edges of the inner surface, adjacent a setting or ornamental section are provided with a bombe configuration. U.S. Pat. No. 5,003,678 discloses a channel set ring providing a plurality of substantially equidistantly spaced depressions formed in the bottom of a U-shaped groove. Setting holes are formed centrally in each of the plurality of depressions. U.S. Pat. No. 4,821,533 discloses a method of setting precious stones in jewelry, which includes: providing a metal support element of U-shaped cross section with two lateral bands separated by a central band defining between them a channel, providing holes in the lateral bands, placing the stones into the channel, and securing the stones in place in the channel with a wire passed through the holes from one band to the other across the channel. U.S. Pat. No. 1,855,331 relates to finger rings and particularly to finger rings provided with emblems or figures around the band thereof. The ring band has a set of recesses therein, each of which has an emblem mounted therein.

Not all jewelry incorporates rigidly fixed ornamentation. A number of patents have been issued for jewelry pieces having movable or removable stones or other elements. U.S. Pat. No. 6,065,971, for example, discloses a finger ring counting device to enable persons to accurately count prayers while saying the rosary. The counting device is embodied in a ring structure which can be inconspicuously worn on the hand, and on which there are a number of beads, which are manually movable around the circumference of the ring for counting. U.S. Pat. No. 5,758,945 discloses a device for enhancing the brilliancy of transparent or translucent stones used in jewelry pieces. A tract assembly with one or more channels is mounted in a conspicuous position of a jewelry piece. One or more carriers holding the stones in a through opening are slidably mounted within the channels.

Although the above-described references relate to the subject matter of jewelry, none of the above-described references disclose the novel structure of the present invention, as is described below.

SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

In one embodiment, the present invention comprises a jewelry assembly incorporating at least two separate elements movable with respect to one another. The assembly incorporates a first jewelry element having a hollow, generally-cylindrical body having an inner surface, an outer surface having a track disposed therein, a first end surface, a second end surface disposed opposite the first end surface. The assembly also incorporates at least one additional jewelry element having a base captured within and slidably movable along the track and a bauble or jewel connected to the base.

In a second embodiment, the present invention is a jewelry assembly incorporating two or more elements slidably connected to one another. The first element has a hollow, generally-cylindrical body having an inner surface, an outer surface, a track disposed in the outer surface, a first end surface, and a second end surface disposed opposite the first end surface. The track has an internal surface, an external surface, and a slot disposed in the external surface. The second jewelry element has a base captured within and slidably movable along the track and a bauble or jewel connected to the base.

The novel features of the present invention will become apparent to those of skill in the art upon examination of the following detailed description of the invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

Figure 1:
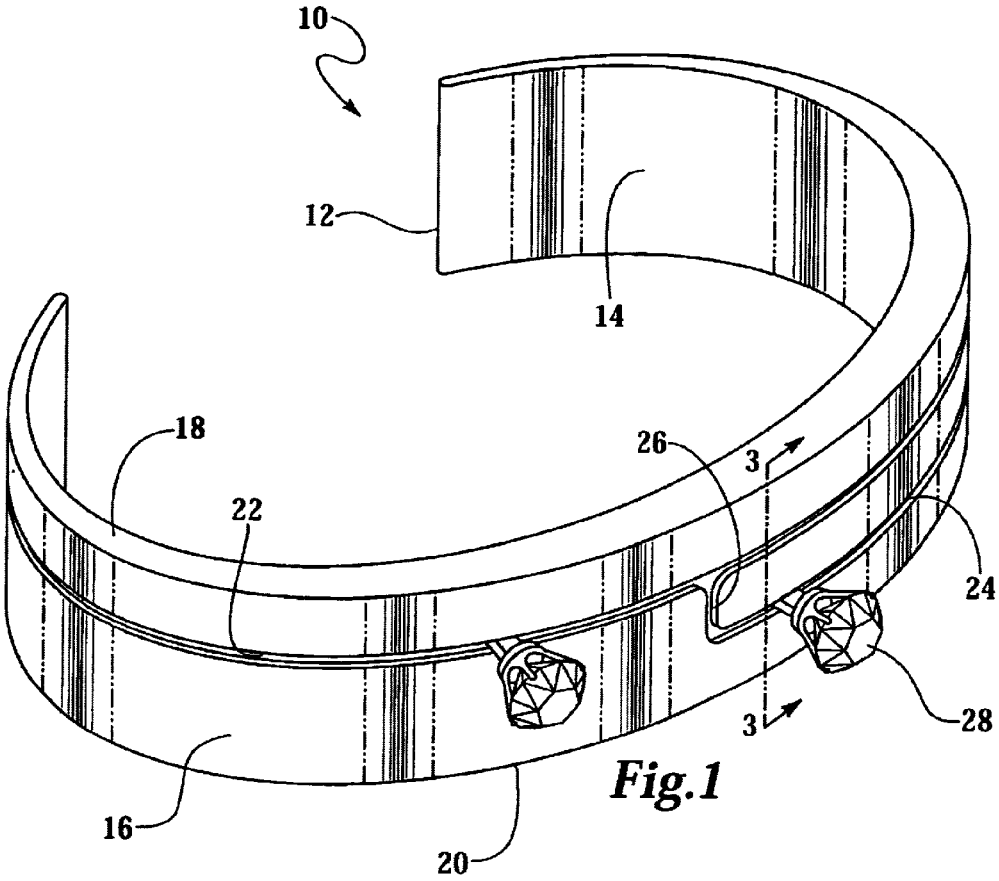
FIG. 1 is an isometric view of a bracelet according to one embodiment of the present invention.

FIG. 1 is an isometric view of a bracelet 10 according to one embodiment of the present invention. The bracelet 10 shown in FIG. 1 has a set of surfaces including an inner surface 14, an outer surface 16, an upper surface 18, and a lower surface 20. Within the bracelet 10 shown in FIG. 1 are a series of tracks, specifically an upper track 22, a connecting track 26, and a lower track 24, along which a jewel assembly 28 travels.

Figure 2:
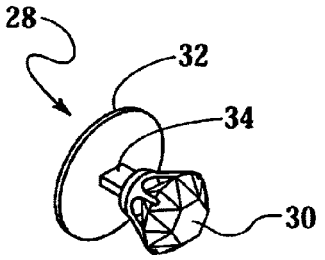
FIG. 2 is an isometric view of a jewel and carrier assembly according to one embodiment of the present invention.

FIG. 2 is an isometric view of a jewel assembly 28 according to one embodiment of the present invention. The jewel assembly 28, as shown in FIG. 2, incorporates a jewel assembly base 32 connected to a stem 34, which is in turn connected to a jewel 30.

Figure 3:
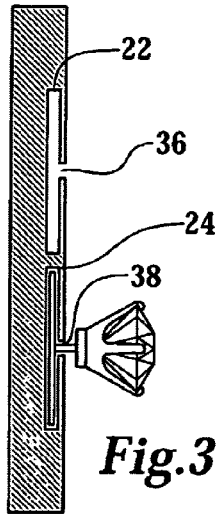
FIG. 3 is a section view of the bracelet along line 3—3 of FIG. 1.

FIG. 3 is a section view of the bracelet 10 along line 3—3 of FIG. 1. FIG. 3 depicts a cross-sectional view of upper track 22, lower track 24, upper track outer surface cut 36, and lower track outer surface cut 38.

With reference to FIGS. 1–3, the bracelet body 12 may be cylindrically shaped to comfortably fit around the wearer's wrist, however, the bracelet body 12 may be angular and polygonal in shape to resist unwanted movement of the bracelet 10. The bracelet body 12 may be formed of metal to increase durability and improve the functional integrity of the bracelet 10. The bracelet body 12 may, however, be made of plastic or wood based upon the wearer's preferences. The finish of the inner surface 14 may be smooth, to prevent injury to the wearer or slightly textured to decrease the tendency of the bracelet 10 to spontaneously travel along the wearer's wrist. The finish of the outer surface 16 may be textured or finished in a glossy and smooth manner to enhance the reflective and aesthetic value of the bracelet 10. The upper surface 18 and lower surface 20 may be finished in a smooth and glossy manner to prevent injury to the wearer as well as increase the aesthetic value of the bracelet 10. Alternatively, the upper surface 18 and lower surface 20 may be finished in a textured manner to increase the contrast between the surfaces of the bracelet 10.

Within or along the outer surface 16 and the bracelet body 12, there are one or more tracks 22–26 that provide guidance to the movement of the jewel assembly 28. Upper track 22 and lower track 24 are formed into the bracelet body 12. In an alternative embodiment, the tracks 22–26 may be raised structures that protrude from the outer surface 16 and provide guidance to the jewel assembly 28.

The lower track outer surface cut 38 and upper track outer surface cut 36 are located above the respective track (i.e. upper track 22, lower track 24, connecting track 26). The outer surface cut 36 provides a channel that may assist in the constraint and guidance of the movement of the jewel assembly 28 by constraining the movement of the jewel assembly stem 34. The thickness of the upper track outer surface cut 36 and lower track outer surface cut 38 may be limited to a dimension slightly larger than the thickness of the stem 34 to provide guidance to and limit the extraneous movement of the jewel assembly 28. The thickness of the outer surface cuts 36–38 should be less than the diameter of the jewel assembly base 32 such that the jewel assembly 28 will remain within the track if the bracelet body 12 is inverted.

As specifically shown in FIG. 1, the upper track 22 may be continuous as it traverses an interior circumference of the bracelet body 12. Alternatively, the tracks 22–26 may be compartmentalized to allow a set of multiple jewel assemblies 28 to traverse a set of separate tracks. FIG. 1 depicts a lower track 24 that is parallel to the upper track 22 with a starting point at the midpoint of the upper track 22. Specifically in FIG. 1, a connecting track 26 runs perpendicular to both the upper track 22 and lower track 24. Alternatively, the lower track 24 and upper track 22 may intersect and allow transition of the jewel assembly 28 between tracks 22–24 without the assistance of a connecting track 26.

The corners at the intersections of the outer surface cuts 36–38 of the connecting track 26, the upper track 22, and the lower track 24 may be curved to provide the wearer the ability to easily move and rotate the jewel assembly 28 from the lower track 24 to the upper track 22. Alternatively, if restraining the movement of the jewel assembly 28 is of greater concern, then the outer surface cuts 36–38 may not be curved.

Now turning specifically to FIGS. 2 and 3, FIG. 2 is an isometric depiction of one embodiment of the jewel 30 and the jewel assembly 28. FIG. 3 is a cross-sectional view of the upper track 22 and lower track 24 within the bracelet body 12 taken along line 3—3 of FIG. 1. The depth and width of the upper track 22, lower track 24, and connecting track 26 may be identical. The respective track 22–26, however, should be greater in depth than the cylindrical height of the jewel assembly base 32 and greater in width than the diameter of the jewel assembly base 32. The depth of the upper track 22 and lower track 24 may be slightly larger than the thickness of the jewel assembly base 32 to create a minimal tolerance between the two entities. The tolerance between the thickness of the jewel assembly base 32 and the depth of the upper track 22, lower track 24, and connecting track 26 may be kept at a minimum so that the tolerance allows free movement of the jewel assembly 28 along the respective track without allowing extraneous movement of the jewel assembly 28 that may disturb the wearer. Alternatively, if extraneous movement of the jewel assembly 28 is of little concern to the wearer, then the tolerance can be increased to reduce the overall cost of manufacture of the bracelet 10.

In one embodiment, the jewel assembly base 32 or the surface of the upper track 22, lower track 24, or connecting track 26 may be lined with a surface that would provide frictional resistance to the movement of the jewel assembly 28. For example, the walls of a respective track and the jewel assembly base 32 may be lined with VELCRO or a VELCRO-like material to allow the wearer to easily urge the jewel assembly 28 to a desired location along the respective track and then secure the jewel assembly 28 at the desired location. In another embodiment, the interior walls of the upper track 22, lower track 24, or connecting track 26, may be lined with retractable or non-retractable structures which would limit the movement of the jewel assembly 28 along the respective track to between the structures. In yet another embodiment, the jewel assembly base 32 may contain a spring or latch mechanism that would allow the user to fix the location of the jewel assembly 28 within a respective track as desired 28. In another embodiment, the jewel assembly base 32 and/or the tracks 22–26 may be magnetized to prevent the undesired movement of the jewel assembly 28.

Turning specifically to FIG. 2, the stem 34 and jewel assembly base 32 may be constructed of metal to provide structural integrity and durability. Alternatively, the stem 34 and jewel assembly base 32 may be fabricated of plastic to reduce the weight and cost of the respective items. The stem 34 of the jewel assembly 28 may be attached to a jewel 30 or a bauble if the wearer so desires. The jewel assembly base 32 may be cylindrical in shape to allow the easy rotation of the jewel assembly 28, typically at the intersections of the tracks. Alternatively, the jewel assembly base 32 may be polygonal in shape to provide greater frictional resistance to the movement of the jewel assembly 28. The diameter of the jewel assembly base 32 should be less than the width of the narrowest track to allow the jewel assembly base 32 to fit within the confines of the respective tracks 22–26. The thickness of the stem 34 may be varied based upon the size of the jewel assembly 28, the size of the jewel 30, the weight of the jewel 30, and the height and length of the stem 34 itself.

Returning to FIGS. 1–3, the bracelet body 12 may be worn by the wearer on his/her wrist as an ornamental item. The free movement of the jewel assembly 28 along the upper track 22, lower track 24, or connecting track 26 enhances the visibility of the jewel 30 to others allowing the wearer to better display the jewel 30. Moreover, the ability of the jewel assembly 28 to travel the upper track 22, lower track 24, and connecting track 26 reduces the likelihood of unwanted separation of the jewel 30 from the jewel assembly 28 that occurs in conventional rigid jewel stems and assemblies. If the wearer is able to secure the position of jewel assembly 28 at a respective point on a respective track, then the wearer is able to position the jewel 30 at an outer surface 16 location that is most desirable to the wearer.

Figure 4:
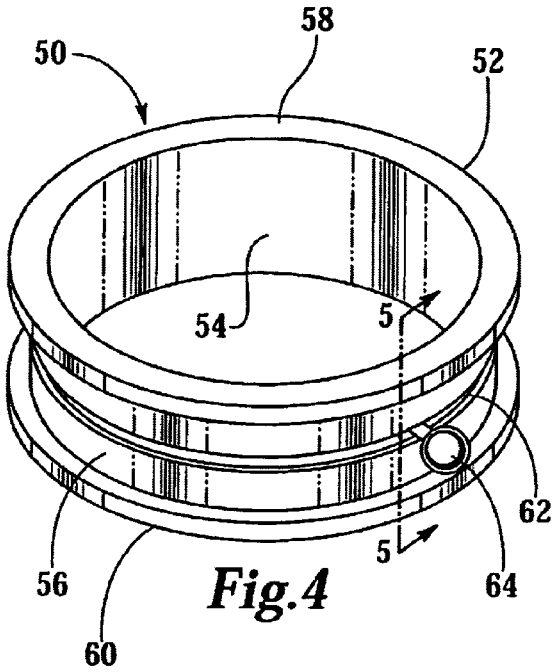
FIG. 4 is an isometric view of a ring assembly according to a second embodiment of the present invention.
Figure 5:
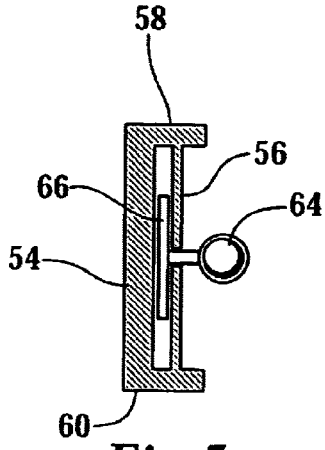
FIG. 5 is a section view of the ring assembly along line 5—5 of FIG. 4.

FIG. 4 is an isometric view of a ring assembly 50 according to a second embodiment of the present invention. FIG. 5 is a section view of the ring assembly along line 5—5 of FIG. 4. The ring assembly 50, depicted by FIGS. 4 and 5, has a ring body 52, inner surface 54, outer surface 56, upper surface 58, and lower surface 60. Between the outer surface 56 and inner surface 54, a track 62 provides guidance to the movement of the jewel assembly base 66 and jewel assembly 64.

The ring assembly 50 and ring body 52 may be cylindrical in shape to comfortably fit around the wearer's finger. Alternatively, the ring assembly 50 and ring body 52 may be polygonal in shape to conform to the wearer's aesthetic desires. Moreover, the ring assembly 50 and ring body 52 may be formed of metal to increase the durability and aesthetic value of the ring assembly 50 and ring body 52. Alternatively, the ring assembly 50 and ring body 52 may also form plastic to decrease the relative weight and expense.

The finish of the inner surface 54 may be smooth to prevent injury and irritation to the wearer. The finish may, however, be textured to prevent against unwanted movement. The inner surface 54 may be cylindrical in shape as to allow the wearer to place the ring assembly 50 relatively snugly around his/her finger. Alternatively, the inner surface may be polygonal in shape to conform to the wearer's desires. The finish of the outer surface 56 may be smooth or textured. The outer surface 56 may be finished with a lacquer or other finish to enhance the reflective and aesthetic value of the ring assembly 50.

The finish of the upper surface 58 may be smooth to prevent injury to the wearer. Alternatively, the finish of the upper surface 58 may be textured to provide a contrast between the surfaces of the ring assembly 50. The upper surface 58 and lower surface 60 may be cylindrical in shape. The upper surface 58 and lower surface 60 may be concentric with the inner surface 54 and the outer surface 56 to aesthetically match the shape of the inner surface 54 and outer surface 56. Alternatively, the upper surface 58 and lower surface 60 may be angular and polygonal in shape to conform to the aesthetic desires of the wearer. The finish of the lower surface 60 may be smooth to prevent injury to the wearer. Alternatively, the lower surface 60 may be finished in a textured manner to increase the contrast between surfaces 54–60 of the ring assembly 50. The lower surface 60 may be identical in size, shape, and thickness to the upper surface 58 to increase the visual symmetry of the ring assembly 50. Alternatively, the lower surface 60 may be varied in size, shape, and thickness, as compared to the upper surface 58, to conform to the aesthetic desires of the wearer.

A track 62 is located underneath the outer surface 56 and may run the entire circumference of the outer surface 56 if the wearer so desires. Alternatively, the track 62 may run a limited arc of the circumference of the outer surface 56. The track 62 has an opening that runs along the circumference of the outer surface 56 through which the stem of the jewel assembly 64 remains attached to the jewel assembly base 66 as the jewel assembly 28 travels the track 62. The width of the track 62 opening in the outer surface 56 may be a value slightly greater than the thickness of the stem of the jewel assembly 64 as to allow free movement of the jewel assembly 64 along the track 62 without excessive and undesired movement of the jewel assembly 64. Alternatively, the wearer may increase the width of the track 62 opening to decrease the amount of material used in constructing the ring and to reduce production costs. The width of the track 62 opening should not be greater than the diameter of the jewel assembly base 66 in order to prevent separation of the jewel assembly 64 from the track 62.

The depth of the central track 62 may be slightly greater than the cylindrical height of the jewel assembly base 66 to allow free movement of the jewel assembly 64 within the track 62 while simultaneously preventing excessive and unwanted movement of the jewel assembly 64. Alternatively, to reduce production costs, close tolerance between the depth of the central track 62 and cylindrical height of the jewel assembly base 66 may not be maintained.

The jewel assembly base 66 may be cylindrical in shape to allow ease of movement along the track 62. The jewel assembly base 66 may, however, be polygonal in shape to provide frictional resistance to the movement of the jewel assembly base 66 along the tack 62. The jewel assembly 64 and the jewel assembly base 66 may be fabricated of metal to increase the durability and structural integrity of the jewel assembly 64 and the jewel assembly base 66. Alternatively, the jewel assembly 64 and the jewel assembly base 66 may be fabricated of plastic to reduce the weight and cost of the ring 50.

The capacity of the jewel assembly 64 to freely traverse the outer surface 56 of the ring assembly 50 enables the wearer to position the jewel assembly 64 in a manner that is most aesthetically pleasing to the wearer. Moreover, the capacity of the jewel assembly 64 to freely move about the outer surface 56 reduces the likelihood of breakage of the jewel assembly 64 due to forces that cause failure on conventional rigid jewel assemblies.

Figure 6:
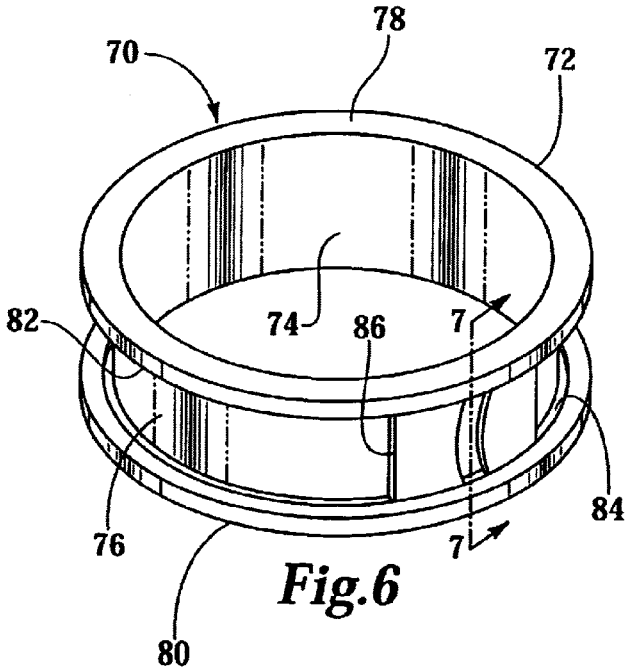
FIG. 6 is an isometric view of a ring assembly according to a third embodiment of the present invention.
Figure 7:
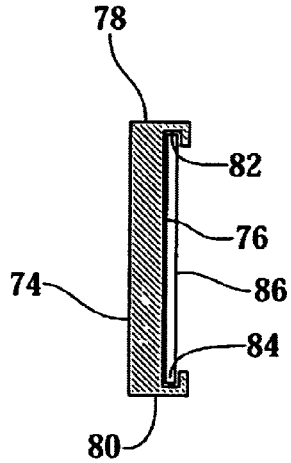
FIG. 7 is a section view of the ring assembly of FIG. 6 along line 7—7.

FIG. 6 is an isometric view of a ring assembly according to a third embodiment of the present invention. FIG. 7 is a section view of the ring assembly of FIG. 6 along line 7—7. The ring 70 depicted by FIGS. 6 and 7 has a ring body 72, inner surface 74, outer surface 76, upper surface 78, and lower surface 80. Within the ring 70 depicted by FIGS. 6 and 7 are an upper grove 82, lower grove 84, and carrier assembly 86. The carrier assembly 86 travels above the outer surface 76.

The ring 70 and ring body 72 may be cylindrical in shape to best fit the wearer's finger. Alternatively, the ring 70 and ring body 72 may be polygonal in shape to conform to the wearer's aesthetic desires. The ring 70 and ring body 72 may be constructed of metal to improve the durability and aesthetic value of the ring 70. Alternatively, the ring 70 and ring body 72, may be constructed of plastic to decrease the relative weight and expense of the ring 70. The finish of the inner surface 74 may be smooth to prevent injury to the wearer. The finish of the inner surface 74 may, however, also be textured to resist against unwanted movement by providing a friction fit with the wearer's finger. The inner surface 74 may be cylindrical in shape to allow the wearer to place the ring 70 on his/her finger. Alternatively, the inner surface 74 may be polygonal in shape to conform to the wearer's aesthetic desires.

The outer surface 76 may be finished smoothly to allow easy movement of the carrier assembly 86 while simultaneously enhancing the reflective and aesthetic value of the ring 70. Alternatively, the outer surface 76 may also be finished in a textured manner to increase the visual contrasts between the surfaces 74–80 of the ring 70. The upper surface 78 may be shaped in a cylindrical manner and may be concentric with the inner surface 74 to aesthetically comport with the shape of the inner surface 74. Alternatively, the upper surface 78 may be polygonal in shape to conform with desires of the wearer. The upper surface 78 may be finished smoothly to prevent injury to the wearer. Alternatively, the upper surface 78 may be textured to increase the visual contrasts between the surfaces 74–80 of the ring 70. The lower surface 80 may be identical in size, shape, and texture to the upper surface 78 to improve the symmetrical appearance of the ring 70 and to increase the aesthetic value of the ring 70. Alternatively, the upper surface 78 and lower surface 80 may be varied in size, shape, and texture to conform to the aesthetic desires of the wearer.

The upper grove 82 and lower grove 84 restrain the movement of the carrier assembly 86 above or along the outer surface 76 of the ring 70. The depth of the upper grove 82 and lower grove 84 is of a relatively small value as compared to the length of the carrier assembly 86. The diminutive value of the depth of the upper grove 82 and lower grove 84 with respect to the cross-sectional height of the carrier assembly 86 allows the maximum surface of the carrier assembly 86 to be exposed while still providing sufficient resistance to prevent the carrier assembly from traveling outside the bounds of the respective upper grove 82 and lower grove 84. The heights of the upper grove 82 and lower grove 84 are larger than the thickness of the carrier assembly 86. The heights of the upper grove 82 and lower grove 84 may be slightly larger than the thickness of the carrier assembly 86 thereby creating a small tolerance between the two structures. The relatively small tolerance between the height of the upper grove 82, lower grove 84 and the carrier assembly 86 allows for smooth travel of the carrier assembly 86 along the outer surface 76 without excessive and undesired movement of the carrier assembly 86. Alternatively, the tolerance between the groves 82–84 and the carrier assembly may be increased to reduce the fabrication costs.

The curvature of the upper grove 82 and lower grove 84 may be concentric with the curvature of the outer surface 76 to allow fluid movement of the carrier assembly 86 along the outer surface 76. Alternatively, the upper grove 82 and lower grove 84 may be off center from the center of the outer surface 76 so that the carrier assembly 86 travels above the outer surface 76 such that a noticeable gap exists between the outer surface 76 and the bottom surface of the carrier assembly 86. The upper grove 82 and lower grove 84 may be identical with respect to their dimensions and surface finishes to allow for consistent movement of the carrier assembly 86 along the outer surface 76. Alternatively, the upper grove 82 and the lower grove 84 may be varied with respect to their dimensions to allow for vertical and rotational movement of the carrier assembly 86.

In order to allow for easy and smooth movement of the carrier assembly 86 along outer surface 76, the carrier assembly 86 may be curved to generally match the curvature of the outer surface 76, upper grove 82, and lower grove 84. Alternatively, the curvature of the carrier assembly 86 may be varied from the curvature of the upper grove 82 and lower grove 84 so that the variation in curvature creates frictional resistance against the movement of the carrier assembly 86. On the upper surface of the carrier assembly 86 a jewel or bauble may be attached if so desired by the wearer.

Figure 13:
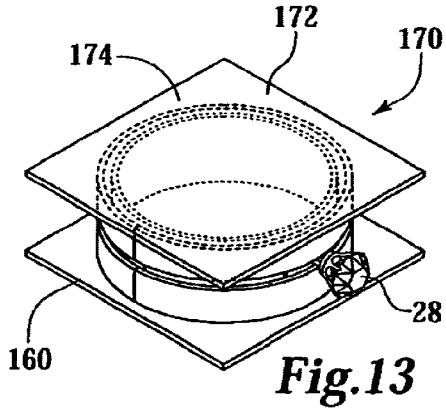
FIG. 13 is an isometric view of a ring assembly prior to trimming.
Figure 14:
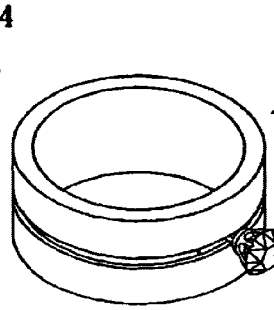
FIG. 14 is an isometric view of a ring assembly after trimming.
Figure 15:
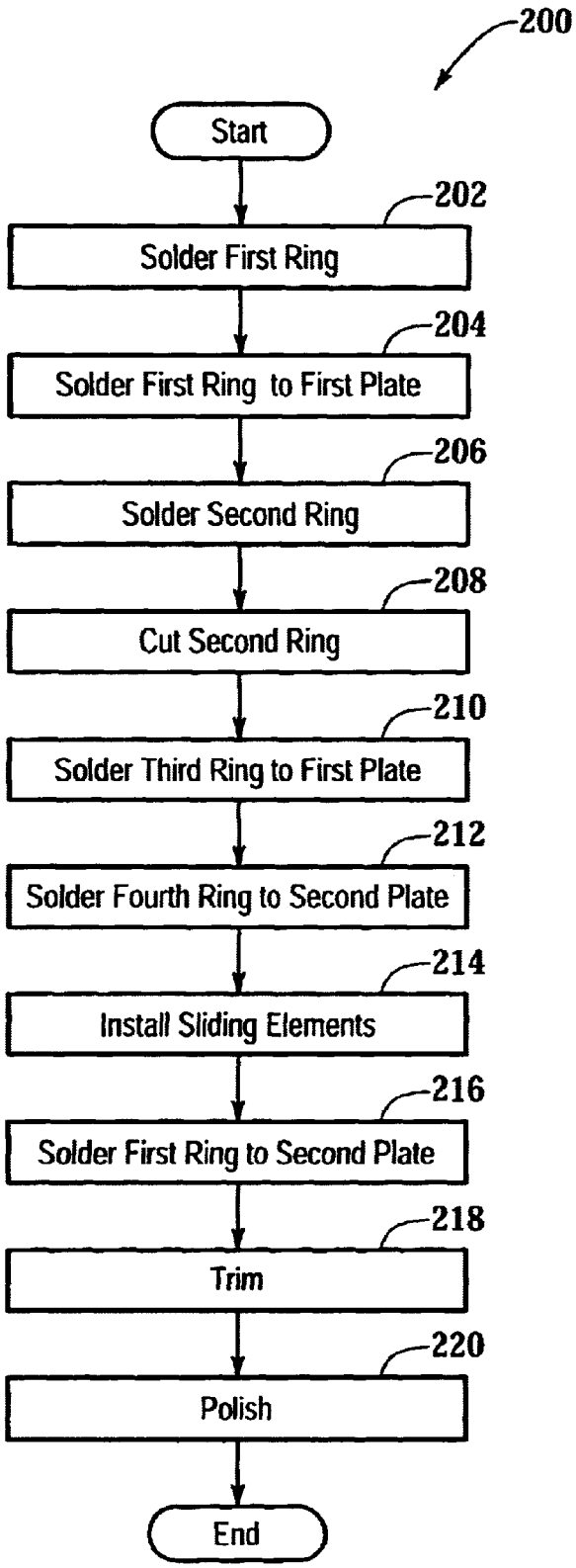
FIG. 15 is a flowchart depicting the method of assembly shown in FIGS. 8–14.

FIGS. 8–15 depict the assembly process for a ring according to one embodiment of the present invention. FIGS. 8–14 depict various stages of the assembly process, which are shown in FIG. 15 in flowchart form.

Figure 8:
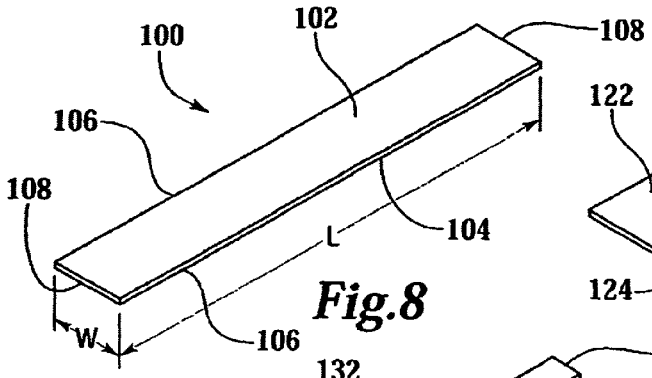
FIG. 8 is an isometric view of a metal strip used in the construction of the ring assembly of FIG. 4.

FIG. 8 is an isometric view of a strip used in the construction of a ring assembly. FIG. 8 depicts a strip 100 with a top surface 102, bottom surface 104, a pair of edges 106, and a pair of ends 108. The planar dimensions of the strip 100 are a width W and length L.

The strip 100 may be fabricated of metal to increase durability. Alternatively, the strip 100 may be fabricated of plastic to reduce production costs. Procurement of the strip 100 is the starting point 200 referenced by the flowchart in FIG. 15. The shape of the strip 100 is polygonal to allow for ease of manufacture. The strip may be fashioned in a manner such that the width W dimension is relatively smaller than the length L dimension. The strip 100, when bent in a manner to create a cylinder, may produce a cylinder having a relatively small cylindrical height in comparison to the circumference. The ends of the strip 100 may be complementary in shape such that when joined to form a generally circular cylinder the joint will form a continuous top surface 102 and bottom surface 104. Alternatively, the ends of the strip may be contrasting in shape such that when joined the surfaces 102 and 104 are no longer continuous. Moreover, the edges 106 may be flat as to simplify the manufacture process.

Figure 9:
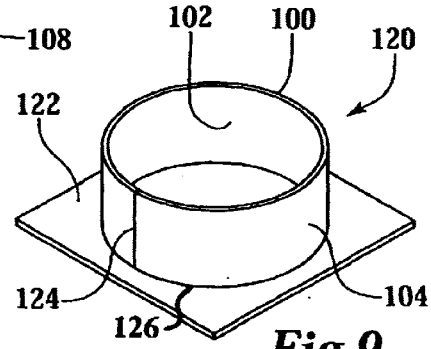
FIG. 9 is an isometric view of a plate-and-ring sub-assembly according to one embodiment of the present invention.

Now turning to FIG. 9, this figure depicts an isometric view of a plate-and-ring sub-assembly 126 according to one embodiment of the present invention. Sub-assembly 126 incorporates a bent strip 100 that has an inner surface 102 and outer surface 104 where the bent strip 100 is joined at the ends by a strip joint. FIG. 9 depicts a bent strip 100 that is connected to a plate 122 at a plate joint.

The strip 100 may be bent, in a circular manner, around an axis that is perpendicular to the length dimension L and parallel to the width dimension W in order to fit comfortably against the wearer's finger. Alternatively, the strip 100 may be bent in an angular fashion such that the bent strip 100 forms a polygonal shape that would conform to the aesthetic desires of the wearer. To increase the comfort of the wearer, the ends 108 may be connected in a manner that creates a flush and continuous inner surface 102. Alternatively, the ends 108 may be joined in a manner that creates a ledge or protrusion that provides resistance against unwanted movement of the ring assembly 50 along the wearer's finger. If the strip 100 is made of metal, then the ends 108 of the strip 100 may be connected by soldering the ends 108 forming a soldered strip joint. In an alternative embodiment, if the strip 100 is fashioned of plastic, for example, the strip joint may be attached by using an adhesive or a fastener mechanism. The joinder of the strip 100 and ends 108 is referenced by step 202 of the flow chart 200 depicted by FIG. 15.

Subsequent to the bending of the strip 100 and joinder of the ends 108, the reshaped strip 100 is attached to a plate 122. The shape of the plate 122 should generally be complementary to the shape of the edges 106 such that, when joined, the plate 122 and strip 100 would form a flush joint. The plate 122 may be made of metal or may be made of plastic. The plate 122 will generally be larger in width and thickness than the diameter of the bent strip 100. Moreover, the thickness of plate 122 may be relatively small in comparison to the length and width of the plate 122 to reduce the amount of plate 122 material used. Alternatively, the plate 122 may be shaved or cut after joining, to the desired size of the wearer. In one embodiment, if the plate 122 is made of metal, the plate 122 may be attached to the bent strip 100 using solder, creating a soldered plate joint. In an alternative embodiment, if the plate 122 is made of a non-metallic material, the plate 122 may be fastened at the plate joint using an adhesive or a fastener mechanism. The joinder of the strip 100 to the plate 122 is referenced by step 204 of the flow chart 200 depicted by FIG. 15.

Figure 10:
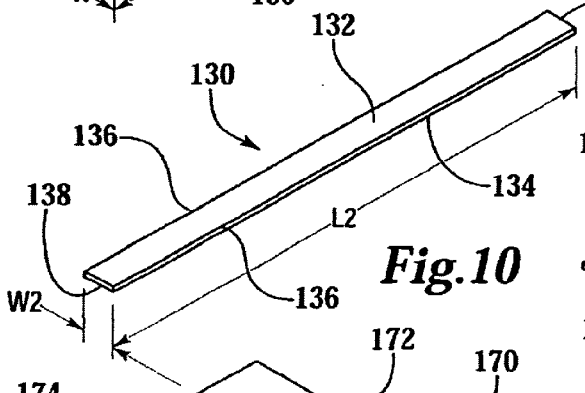
FIG. 10 is an isometric view of a second metal strip used in the construction of the ring assembly of FIG. 4.

Now turning to FIG. 10, this figure is an isometric view of a second strip 130 used in the construction of the ring assembly 130–138 of the instant embodiment shown in FIG. 14. FIG. 10 depicts a strip 130 with a top surface 132, a bottom surface 134, a pair of edges 136, and a pair of ends 138. The dimensions of the strip 130 are width W2 and length L2. The strip 130 may be made of metal or another relatively flexible-material. The strip 130 is preferably rectangular in shape. The strip 130 is slightly larger in length L2 and smaller in width W2 than the first strip 100 referenced in FIG. 8. The ends 138 of the strip 130 may be complementary in shape to provide a flush fit when joined. Moreover, the edges 136 are preferably flat to provide a flush fit against a flat plate.

Figure 11:
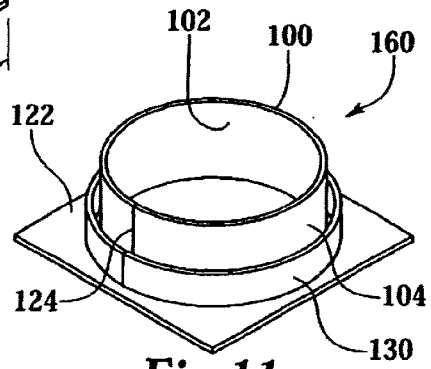
FIG. 11 is an isometric view of a plate and dual-ring sub-assembly according to one embodiment of the present invention.

Now turning to FIG. 11, this figure depicts an isometric view of a dual-ring sub-assembly 160 according to the instant embodiment shown in FIG. 14. FIG. 11 depicts an inner strip 100 with an inner surface 102 and an outer surface 104 that is joined at the ends by a strip joint. FIG. 11 also depicts a plate 122 and an outer strip 130.

The outer strip 130 may be bent in a generally circular manner, preferably similar in shape to the inner strip 100. Alternatively, the outer strip 130 may also be bent in an angular manner such that outer strip 130 forms a polygonal shape. The ends 138 of the outer strip 130 may be connected in a manner that creates a flush and continuous inner surface of the outer strip 130 to allow for an obstruction free channel between the outer strip 130 and the inner strip 100. Alternatively, the outer strip 130 may be joined at the ends 138 in a manner that creates a protrusion that would limit the movement of a jewel assembly within the channel created by the inner strip 100 and the outer strip 130. In one embodiment, where the outer strip 130 is made of metal, the ends 138 of the outer strip 130 may be connected by soldering the ends 138 together forming a soldered strip joint. In an alternative embodiment, where the outer strip 130 is fashioned of plastic, for example, the ends 138 may be attached by using an adhesive or a fastener mechanism.

Subsequent to the bending of the outer strip 130 and joinder of the ends 138, the reshaped outer strip 130 is attached to the plate 122 the inner strip 100 is attached to. The reshaped outer strip 130 is attached to the plate 122 in a manner such that the outer strip 130 is relatively concentric with the inner strip 100. In one embodiment, if the plate 122 is made of metal, the plate 122 may be attached to the bent outer strip 130 using solder creating a soldered plate joint at the intersection of the plate 122 and the bent outer strip 130. However, in an alternative embodiment, if the plate 122 is made of a different material than metal, the bent outer strip 130 may be fastened at the plate joint using an adhesive or a fastener mechanism. The joinder of the outer strip 130 to the plate 122 is reference by steps 206, 208, and 210 of the flow chart 200 depicted by FIG. 15.

Figure 12:
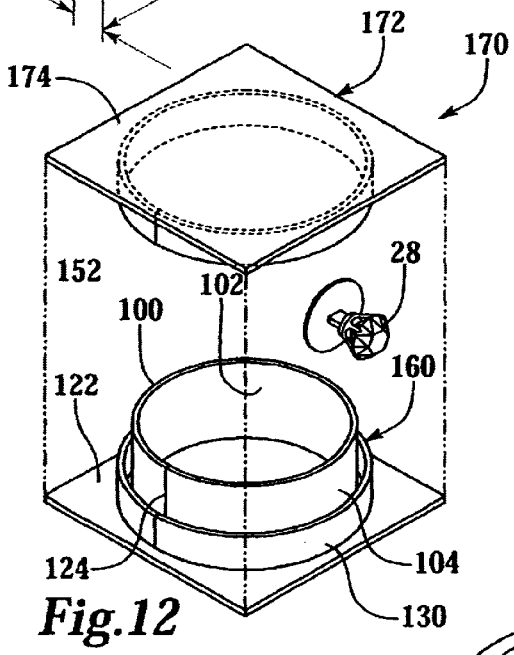
FIG. 12 is an isometric view of the manner of assembly of the upper and lower plate sub-assemblies according to one embodiment of the present invention.

Now turning to FIG. 12, this figure depicts an isometric view of the manner of assembly of the upper and lower plate sub-assemblies according to one embodiment of the present invention. FIG. 12 depicts a jewel assembly 28, an inner strip 100, a lower outer strip 130, an upper outer strip 152, a lower plate 122, an upper plate 172, an upper plate joint 174, a lower dual ring sub-assembly 160, and an upper outer ring sub-assembly 170. The inner strip 100 has an inner surface 102, an outer surface 104, and a strip joint.

The bent upper outer strip 152 is relatively identical in shape and curvature to the lower outer strip 130. Moreover, the sum of the cylindrical height of the upper outer strip 152 and the lower outer strip 130 is less than the cylindrical height of the inner strip 100. The variation of cylindrical heights will create a channel between the upper outer strip 152 and the lower outer strip 130 through which the stem of the jewel assembly 28 will travel. In one embodiment, where the upper outer strip 152 is made of metal the ends of the upper outer strip 152 may be connected by soldering the ends forming a soldered strip joint. In an alternative embodiment, where the upper outer strip 152 is fashioned of plastic, for example, the strip joint may be attached by using an adhesive or a fastener mechanism. Subsequent to the bending of the upper outer strip 152 and joinder of the ends of the upper outer strip 152, the reshaped upper outer strip 152 is attached to an upper plate 172. The upper plate 172 may be made of metal or may also be made of plastic but the upper plate 172 is most effective if the upper plate 172 is made of a relatively rigid material. The upper plate 172 is slightly larger in width and length than the diameter of the upper outer strip 152 in order to limit the amount of upper plate 172 material used. Moreover, the thickness of the upper plate 172 is relatively small in comparison to the length and width of the upper plate 172 to again reduce the volume of upper plate 172 material used. In one embodiment, if the upper plate 172 is made of metal, the upper plate 172 may be attached to the upper outer strip 152 using solder creating a soldered plate joint. However, in an alternative embodiment, the upper plate 172, if it is made of a different material than metal, may be fastened at the plate joint using an adhesive or a fastener mechanism.

The jewel assembly 28 base is placed into the channel created by space between the lower inner strip 100 and the lower outer strip 130 of the lower dual ring sub-assembly 160. The upper outer ring sub-assembly 170 is lowered onto the lower dual ring sub-assembly 160 in a manner such that the upper outer strip 152 is concentric with the lower inner strip 100 and the upper plate 172 intersects the upper edge of the lower inner strip 100. In one embodiment, if the upper plate 172 and the lower inner ring 100 are fabricated of metal, the upper outer ring sub-assembly 170 may be fastened to the lower dual ring sub-assembly 160 by soldering the intersection of the upper plate 172 and lower inner strip 100. In an alternative embodiment, if the upper plate 172 or lower inner strip 100 is fabricated out of a non-metallic material, then the upper outer ring sub-assembly 170 and lower dual ring sub-assembly 160 may be joined by using an adhesive or a fastener mechanism. The joinder of the upper outer strip 152 to the upper plate 172 is reference by step 212 of the flow chart 200 depicted by FIG. 15. The insertion of the jewel assembly 28 and the joinder of the upper plate 172 to the lower inner strip 100 are reference by steps 214 and 216 of the flow chart 200 depicted by FIG. 15.

Now turning to FIG. 13, this figure depicts an isometric view of a ring assembly prior to trimming. FIG. 13 depicts a jewel assembly 28, a lower plate 160, a fastened ring assembly 170, and an upper plate 172.

The excess material of the upper plate 172 and lower plate 160 is removed to allow the wearer to place the ring on his/her finger. Removal of the excess material is conducted through any well-known trimming process. The plate material that is trimmed is the upper plate 172 and lower plate 160 material inside the perimeter circumscribed by the inner surface 102 of the inner strip 100. Moreover, the plate material that is trimmed is the plate material outside the perimeter created by the intersection of the outer surface of the upper outer strip 152 and the upper plate 172 as well as the material outside the perimeter created by the intersection of the outer surface of the lower outer strip 130 and the lower plate 122. The trimming process is referenced by step 218 of the flow chart 200 depicted by FIG. 15.

Now turning to FIG. 14, FIG. 14 is an isometric view of a ring assembly after trimming. FIG. 14 depicts a final ring assembly 170 and a jewel assembly 28.

The exposed surfaces of the finial ring assembly 170 are polished to the finish textures desired by the wearer. In one embodiment, the exposed surfaces of the finial ring assembly 170 may be adorned with an artistic design or message to increase the value of the final ring assembly 170 to the wearer. The polish of the finial ring assembly 170 is referenced by step 220 of the flow chart 200 depicted by FIG. 15.

It can therefore be seen that the instant invention provides a unique and novel device for altering the position of a jewel or carrier assembly as to allow the wearer to best position and highlight the jewel or carrier. Moreover, the instant invention provides a unique device for reducing the likelihood of breakage of the jewel or carrier assembly that occurs in traditional rigid jewel assemblies due to impulse forces.

The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

What is claimed is:

1. A jewelry assembly comprising:

a first jewelry element having a hollow, generally-cylindrical body having a curved inner surface, a curved outer surface having a first track and second track disposed therein and following the profile thereof, a first end surface, a second end surface disposed opposite the first end surface, said first and second tracks intersecting; and a second jewelry element having a base captured within and slidably movable along the first track and a bauble or jewel connected to the base.

2. The jewelry assembly of claim 1 wherein the first jewelry element is a bracelet.

3. The jewelry assembly of claim 1 additionally comprising a third track disposed in the outer surface of the first jewelry element.

4. The jewelry assembly of claim 1 wherein the first track and second track are connected in such manner that the second jewelry element can be moved between the first track and second track.

5. The jewelry assembly of claim 1 additionally comprising a third jewelry element having a base captured within and slidably movable along the second track and a bauble or jewel connected to the base of the third jewelry element.

6. A jewelry assembly comprising:

a first jewelry element having a hollow, generally-cylindrical body having an inner surface;

an outer surface;

a first track disposed in the outer surface comprising, and a first slot;

a second track disposed in the outer surface comprising and a second slot having a first end disposed along the slot of the first track so that the second slot intersects but does not extend past the first slot;

a first end surface; and a second end surface disposed opposite the first end surface; and a second jewelry element having a base captured within and slidably movable along at least one of the tracks and a bauble or jewel connected to the base.

7. The jewelry assembly of claim 6 wherein the first jewelry element is a bracelet.

8. The jewelry assembly of claim 6 additionally comprising a third track disposed in the outer surface of the first jewelry element.

9. The jewelry assembly of claim 6 wherein the first track and second track are connected in such manner that the second jewelry element can be moved between the first track and second track.

10. The jewelry assembly of claim 6 additionally comprising a third jewelry element having a base captured within and slidably movable along the second track and a bauble or jewel connected to the base of the third jewelry element.

11. A bracelet comprising:

a bracelet body having an inner surface, an outer surface, a first track, disposed in the outer surface, comprising a first track first end, a first track second end, and a first track slot in the outer surface of the bracelet body;

a second track, disposed in the outer surface, intersecting the first track between the first track first end and first track second end and comprising a second track slot in the outer surface of the bracelet body;

a bracelet body first end surface; and a bracelet body second end surface disposed opposite the bracelet body first end surface; and a slidable jewelry element having a base captured between the inner and outer surfaces of the bracelet body and within the first and second tracks, and slidably movable along the first and second tracks and movable from the first track to the second track while remaining captured within the bracelet body and a bauble or jewel connected to the base.

12. The bracelet of claim 11 additionally comprising a third jewelry element having a base captured within and slidably movable along the first and second tracks and a bauble or jewel connected to the base of the third jewelry element.

13. The bracelet of claim 11 wherein the inner surface of the bracelet body is curved.

14. The bracelet of claim 11 wherein the outer surface of the bracelet body is curved.

15. The bracelet of claim 11 wherein the bracelet body first end surface is substantially planar.

16. The bracelet of claim 11 wherein the bracelet body second end surface is substantially planar.

17. The bracelet of claim 11 wherein the bracelet body is crescent-shaped.

18. The bracelet of claim 11 wherein the bracelet body is generally cylindrical.

* * * * *